United States Patent [19]

Graybill

[11] 4,080,409

[45] Mar. 21, 1978

[54] VARIABLE VENTURI CARBURETOR

[76] Inventor: Clinton L. Graybill, P.O. Box 396, Superior, Mont. 59872

[21] Appl. No.: 749,448

[22] Filed: Dec. 10, 1976

Related U.S. Application Data

[62] Division of Ser. No. 606,798, Aug. 22, 1975, Pat. No. 4,001,356.

[51] Int. Cl.[2] ..... F02M 7/02

[52] U.S. Cl. ..... 261/40; 261/72 R; 261/121 A; 261/121 B

[58] Field of Search ..... 261/121 A, 40, 62, 121 B, 261/72 R

[56] References Cited

U.S. PATENT DOCUMENTS

| | | | |
|---|---|---|---|
| 1,204,901 | 11/1916 | Plant | 261/40 |
| 1,313,521 | 8/1919 | Connor et al. | 261/121 A |
| 1,441,992 | 1/1923 | Meden | 261/44 R |
| 1,594,682 | 8/1926 | Morton | 261/62 |
| 1,607,052 | 11/1926 | Brinkman | 261/62 |
| 1,626,085 | 4/1927 | Henriot | 261/62 |
| 1,803,150 | 4/1931 | Stokes | 261/72 R |
| 1,805,763 | 5/1931 | Ensign | 261/72 R |
| 1,813,866 | 7/1931 | Royce | 261/44 R |
| 1,838,392 | 12/1931 | Hale | 261/40 |
| 1,845,668 | 2/1932 | Keil | 261/40 |
| 1,973,362 | 9/1934 | Weiertz et al. | 261/121 A |
| 2,009,233 | 7/1935 | Jennings | 261/62 |
| 2,016,449 | 10/1935 | Moysard | 261/62 |
| 2,084,340 | 6/1937 | Hartsough | 261/62 |
| 2,134,877 | 11/1938 | Jedrzykowski | 261/121 A |
| 2,841,374 | 7/1958 | Raynor | 261/50 A |
| 3,857,912 | 12/1974 | Cedarholm | 261/144 |

FOREIGN PATENT DOCUMENTS

| | | | |
|---|---|---|---|
| 422,627 | 1/1935 | United Kingdom | 261/121 A |

*Primary Examiner*—Tim R. Miles

*Attorney, Agent, or Firm*—Wells, St. John & Roberts

[57] ABSTRACT

A variable venturi carburetor comprised of an open carburetor body enclosing an interior first venturi member and coaxial peripheral second venturi member. The second venturi member is integral with the carburetor body and defines a peripheral annular fuel dispensing orifice. The first venturi member is movable relative to the second venturi member along an upright axis. The venturi members together define an annular restricted air passage adjacent the fuel dispensing orifice that may be varied in size to increase or decrease the volume and velocity of air passing by the orifice. Fuel is supplied from an annular fuel chamber to the orifice in response to movement of air thereby. Various air bleed provisions are made to insure proper air-fuel mixing throughout the entire operational range of the engine on which the carburetor is attached. Provisions are also made to bleed air into the fuel supply as it is being delivered to the mixing chamber in order to premix a charge of air and fuel before it enters the carburetor mixing chamber.

7 Claims, 10 Drawing Figures

VARIABLE VENTURI CARBURETOR

RELATED APPLICATIONS

This is a division of application Ser. No. 606,798 filed Aug. 22, 1975 and titled "Variable Venturi Downdraft Carburetor,", now U.S. Pat. No. 4,001,356.

BACKGROUND OF THE INVENTION

The present invention relates basically to the field of carburetion for internal combustion engines and more particularly to carburetors utilizing a variable venturi.

Most present automobile carburetors are designed with a fixed venturi to create a vacuum pressure in the induction duct in order to pull fuel from a fuel reservoir. The venturi, by its fixed nature, operates at a maximum efficiency over a small range of engine RPM. Furthermore, a different size venturi is generally required for different size engines in performance requirements. Seldom is an automobile operated in only the small range of speeds required for the maximum operational efficiency of the fixed venturi. Consequently, various complicated venturi arrangements including multiple venturi tubes have been included in carburetors in an attempt to make the carburetor more efficient over a wide range of operating conditions. A venturi is generally most ineffective at slow speeds in which the velocity of air through the induction duct is minimal. Special idle jets have been incorporated in carburetors in order to overcome this problem by passing additional fuel to the engine at low RPM. At higher RPM, the fuel from the special idle jet is not required and therefore provides a richer mixture than is needed for that particular RPM range. This results in loss of fuel in an over rich mixture of fuel to air. This loss is particularly notable at high speeds and during deceleration.

Other features have been added to carburetors to overcome the limitations noted with the fixed venturi type carburetor. One limitation is recognized when the carburetor is operating at low engine RPM. When the operator desires to quickly accelerate the automobile, quick depression of the throttle pedal causes the throttle valve to rapidly open. This allows for additional amounts of air to flow through the venturi before the vacuum pressure is increased to a higher RPM in order to draw additional fuel. Consequently, it is not infrequent that the engine will stall on the initial lean mixture. To overcome this limitation, accelerator fuel pumps have been incorporated in carburetors to operate in response to depression of the throttle pedal to pump additional fuel into the mixing chamber when the throttle is depressed rapidly. However, such a compromise results in a loss of fuel when the vehicle is traveling at high speeds and the accelerator pump is temporarily released and then depressed again. The pump adds the additional fuel to the engine which is wasted since the high air velocity through the venturi is sufficient to pull enough fuel into the cylinders to accomplish the objective without the necessity of the fuel pump.

It may be seen then that additional features added to existing fixed venturi carburetors frequently cause additional inefficiencies that balance with the limitations that they themselves introduce. All the above mentioned and further features attempt to compensate for the inefficiencies of the venturi over the full range of operating conditions and RPM. Ideally, the carburetor for an automobile should operate at high efficiency over the full range of engine operating RPM and load conditions.

Conventional air valve type carburetors have been utilized in an attempt to maintain a constant air velocity across a fuel jet orifice independent of the throttle valve position and engine speed. Such carburetors generally attempt to vary the size of the fuel jet in accordance with the amount of air entering the carburetor to therefore provide a correct "air-fuel ratio." Engines having such air valve carburetors are generally difficult to start and operate at idling RPM.

Each additional compensating feature added to existing carburetors over the years makes them more complicated and more susceptible to plugging and therefore necessitate more frequent repairs and maintenance adjustments. In addition, the number of moving parts in carburetors has increased substantially over the years making such carburetors extremely complicated and increasingly expensive to manufacture.

The principal reason that variable venturi carburetors have not been a success in the past is because proper metering of fuel at low speeds has been nearly impossible to maintain. With the engine running, a high vacuum is created in the manifold that is so great that prior variable venturi carburetors would deliver too much gasoline to the engine. The result is that the engine floods too easily or becomes very uneconomical to operate at low speed ranges.

It is therefore a primary object of this invention to provide a variable venturi carburetor that will effectively operate throughout the entire engine operation range from idle to full throttle RPM while maintaining a correct air-fuel mixture ratio throughout that range.

An additional object is to provide such a variable venturi carburetor wherein the fuel enters the mixing chamber at a point where the air is moving at an extremely high velocity to thereby thoroughly mix air and fuel prior to its reception by the engine combustion chambers.

An additional object is to provide such a variable venturi carburetor wherein fuel is delivered from a single fuel supply orifice throughout the entire operational range of the engine.

Another principal object of this invention is to provide a carburetor of very simple construction wherein very simple adjustments may be made to vary the fuel-air ratio.

A further object is to provide a single throat carburetor that will operate as efficiently as any presently known multiple throat carburetors.

A yet further object is to provide a variable venturi type carburetor that does not utilize an idle jet, an accelerator pump, a needle valve, or a butterfly type throttle valve.

An additional object is to provide such a carburetor that is adaptable to replace most conventional downdraft type carburetors.

These and still further objects and advantages will become apparent upon reading the following detailed description of a preferred embodiment.

BRIEF DESCRIPTION OF THE DRAWINGS

A preferred embodiment of the present invention is illustrated in the accompanying drawings in which.

DETAILED DESCRIPTION OF A PREFERRED EMBODIMENT

Figure 1:
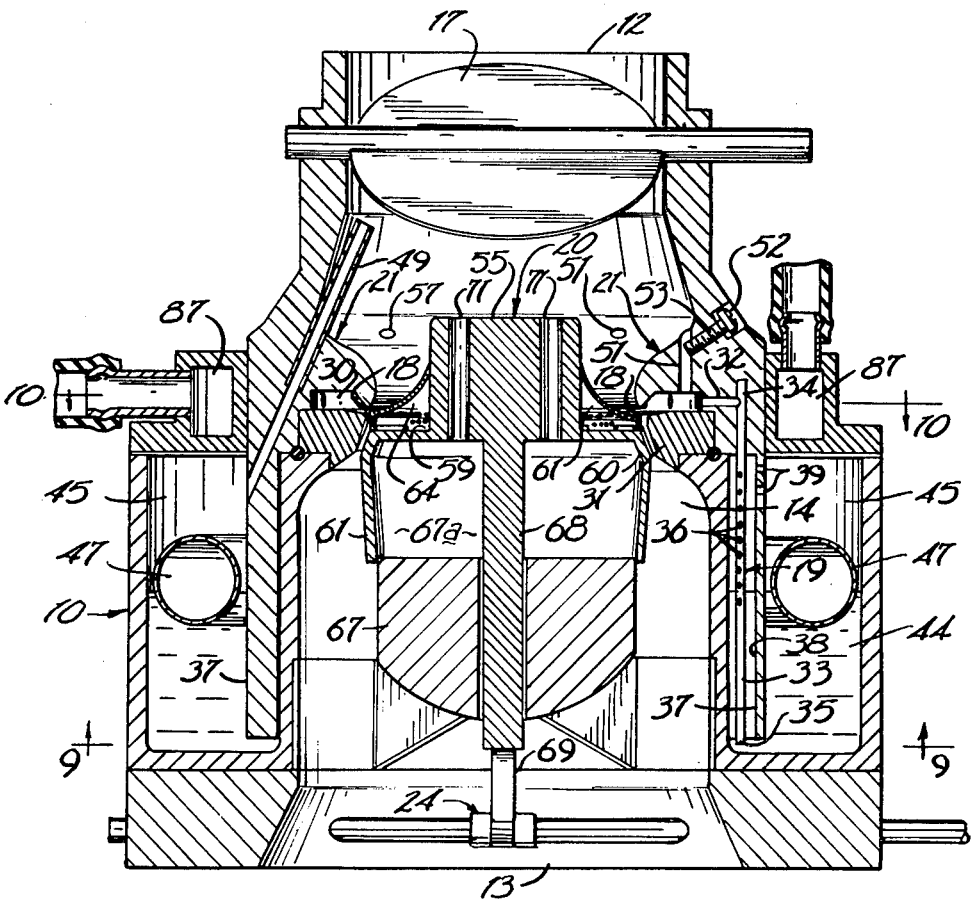
FIG. 1 is a vertical cross-sectional view taken through the center of the present carburetor.

A variable venturi carburetor embodying the present invention is illustrated in the accompanying drawings and is generally designated therein by the reference numeral 10. The carburetor 10 is designed to be mounted to an internal combustion engine by interconnection to the intake manifold of the engine (not shown). Although the carburetor illustrated is shown in a single barrel type configuration, it should be understood that adaptations may be made to successfully mount the present carburetor on existing manifolds built for two, three or four barrel type conventional carburetors.

Basically, the carburetor is comprised of a hollow carburetor body 11 that includes an air passage leading from an open upper end 12 to an open lower end 13. The body 11 is hollow to direct air from the upper open end 12 into an intermediate mixing chamber 14 and out through lower end 13 and into the intake manifold of an internal combustion engine (not shown). A conventional choke 17 is provided across the open upper end 12 to restrict passage of air into the carburetor to facilitate a rich fuel-air mixture for starting purposes in cold weather.

One of the primary features of the present invention is embodied in a fuel dispensing orifice 18 that is annular in configuration and extends about the entire circumference of the mixing chamber 14. Orifice 18 is supplied with a liquid hydrocarbon fuel through a fuel premixing means generally indicated at 19 and other features of primary importance are a first and a second venturi members 20 and 21. Venturi members 20, 21 are located coaxially within the mixing chamber 14 to define a restricted air passage 22. As illustrated, the second venturi member 21 is formed integrally within carburetor body 11 and defines the annular fuel dispensing orifice 18. The first venturi member 20 is axially movable within mixing chamber 14 along an upright axis through operation of a throttle means 24.

Figure 2:
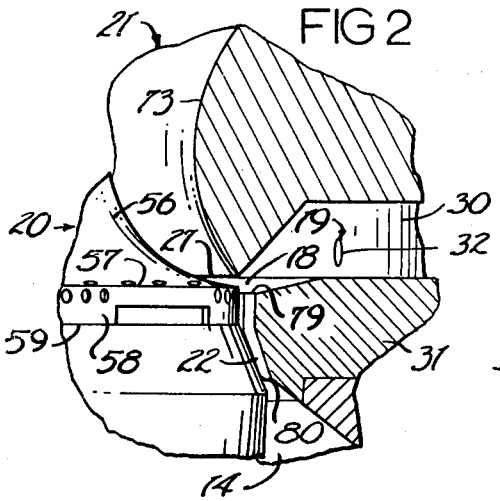
FIG. 2 is an enlarged diagrammatic view illustrating operation of the present invention.

Orifice 18 includes an upper or upstream edge 27 and a downstream axially spaced edge 28 (FIG. 2). These edges bound the portion of orifice 18 openly communicating with mixing chamber 14. An enlarged annular cavity 30 is also included as an integral part of orifice 18 and is openly connected to fuel supply means 19. Cavity 30 serves as an initial mixing area for air and fuel before it exits between edges 27 and 28 and into the airstream passing thereby.

Figure 5:
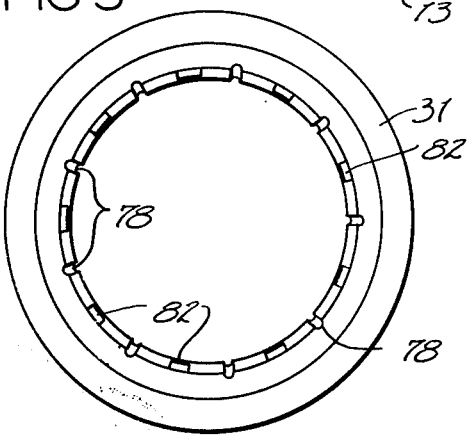
FIG. 5 is a detail plan view of a portion of the present invention.
Figure 8:
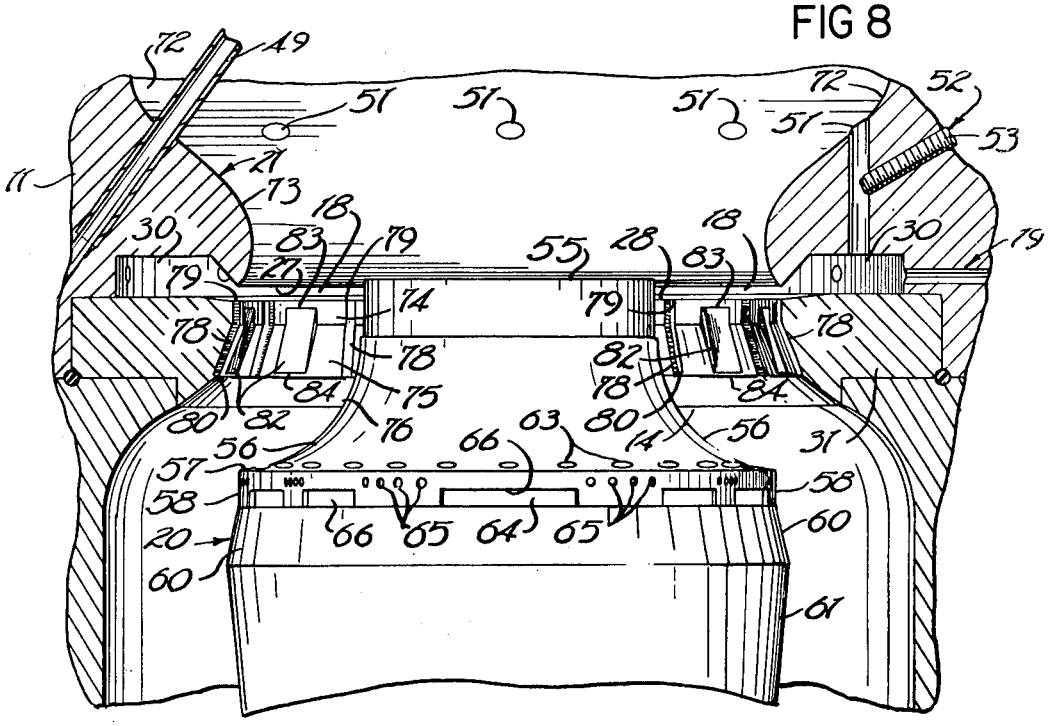
FIG. 8 is an enlarged detailed section view illustrating the variable venturi members at a full throttle condition.

As shown by FIGS. 5 and 8, the lower surface of cavity 30 and edge 28 is defined by a removable ring 31 that is formed as a portion of the second venturi member 21. Ring 31 is removable to facilitate selective adjustment of the restricted air passage size for different performance purposes.

Figure 9:
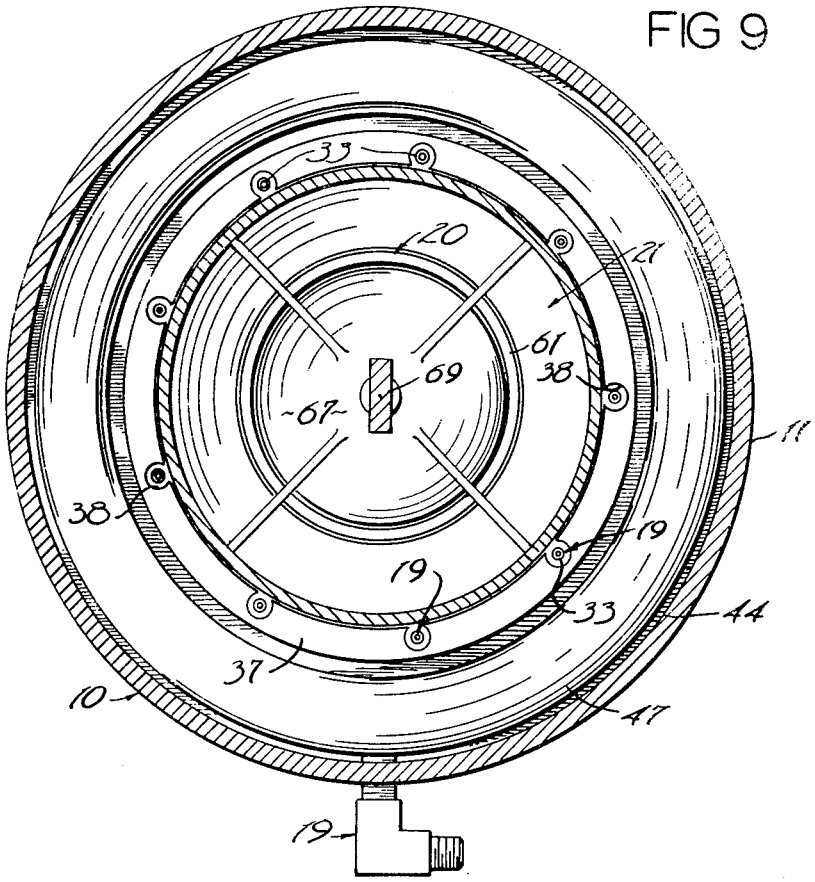
FIG. 9 is a section view taken along line 9—9 in FIG. 1.
Figure 10:
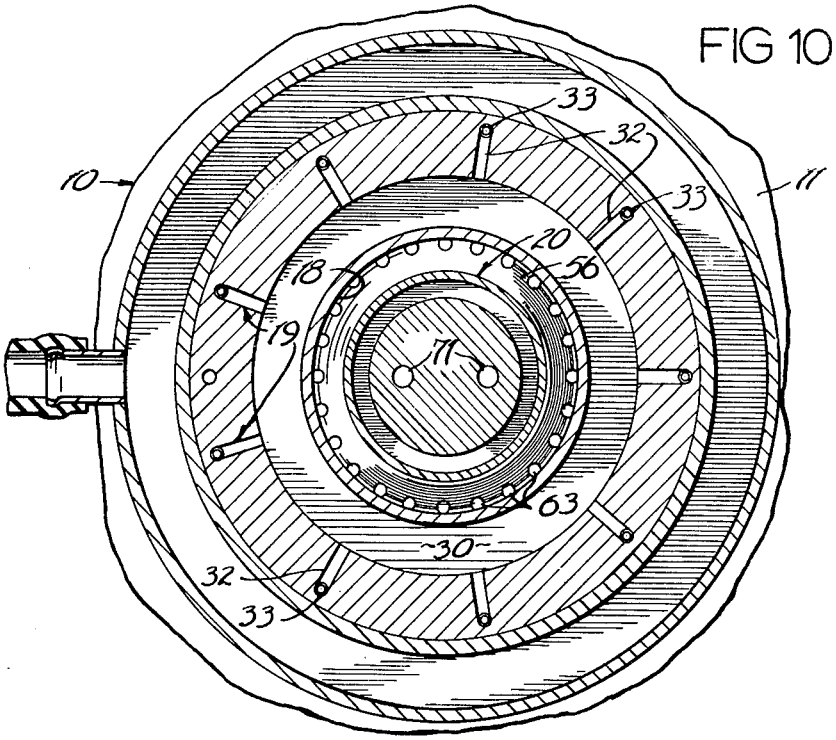
FIG. 10 is a section view taken along line 10—10 in FIG. 1.

Referring now in greater detail to fuel premixing means 19, particular reference will be had to FIGS. 1, 9 and 10. Fuel is supplied to the annular cavity 30 from a float chamber 44 through means of angularly spaced fuel supply tubes 33. Tubes 33 are openly connected to radial ducts 32 that open at ends into chamber 30 at angularly spaced locations.

The individual tubes 33 as shown in FIG. 1 include upper ends 34 that protrude slightly above ducts 32. Lower ends 35 of these tubes are open and extend vertically and axially into float chamber 44. Each tube 33 is centered within a fuel well bore 38 (FIGS. 1 and 9) that also projects into float chamber 44.

Means is provided to bleed air into fuel passing through tubes 33. This means is in the form of a group of vertically spaced holes 36. The holes 36 are located along tubes 33 so a portion thereof opens into an air space above the fuel level within fuel well bores 38, with the remaining holes being located below the fuel level. As fuel is drawn through tubes 33, air is also drawn through the holes 36 located above the fuel level. The air and fuel partially mix together before the fuel is delivered to the fuel dispensing chamber 30.

The fuel well bores 38 are provided at angularly spaced intervals in a skirt 37 extending into float chamber 44. Bores 38 extend from upper ends adjacent the upper side of float chamber 44 to lower open ends spaced below the fuel level. Near the upper closed ends of each bore 38 is a spaced pair of holes 39. These are pressure regulating holes that bleed air from the float chamber to the wells to compensate for varying atmospheric pressure and for partially regulating the mixture of fuel and air passing to the orifice 18. The function of bores 38 and holes 39 will be discussed in greater detail in the following discussion of the operation of the present invention.

Fuel is supplied to float chamber 44 and maintained at a prescribed level therein by a float mechanism 47. Float mechanism 47 may be identical to that shown and described in my pending application, Ser. No. 442,383 filed Feb. 14, 1974 and now U.S. Pat. No. 3,940,460. Therefore, portions of that application regarding the float, a float valve, and a linkage connected thereto are hereby incorporated by reference into this application.

The air space 45 in float chamber 44 communicates with atmospheric air through means of a ventilation tube 49. Tube 49 openly communicates with atmospheric air from an open end protruding into the hollow interior of the carburetor above the restricted air passage. Air pressure within chamber 44 is thereby held equal to the outside atmospheric air pressure.

Figure 4:
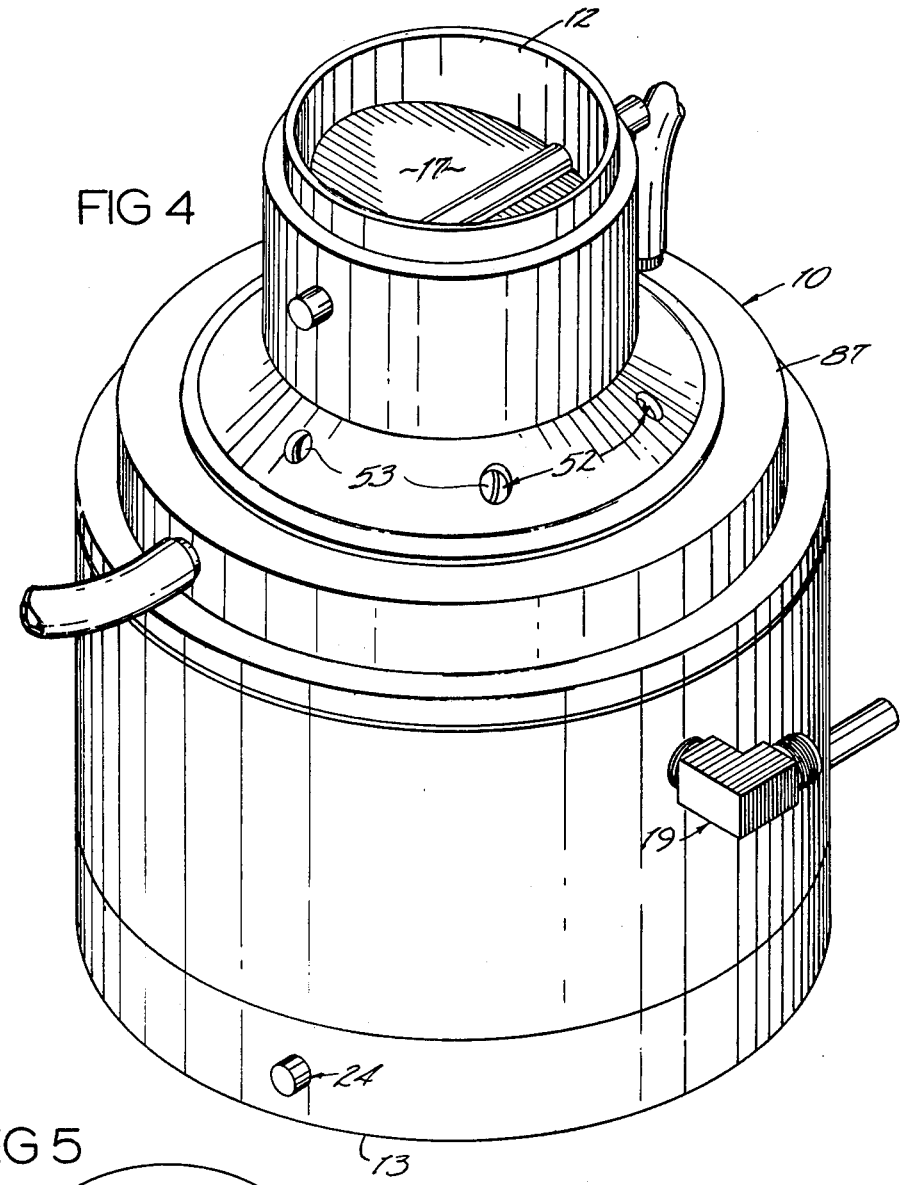
FIG. 4 is an enlarged pictorial view of the exterior of the present carburetor.

In addition to air being bled into the fuel through holes 39, a number of air bleed holes 51 are also provided in second venturi member 21 to bleed air into the orifice cavity 30. Bleed holes 51 are utilized both to assist in premixing the fuel and air and as a means for regulating the air pressure in the orifice chamber 30. An adjusting means 52 is provided in the form of threaded screws 53 to selectively control the amount of air bled through the bleed holes 51. Screws 53 are carried within complementary threaded apertures within the carburetor body 11 intersecting the holes 51. As shown in FIG. 4, several such screws are provided with one for each air bleed hole 51. It is presently contemplated to utilize a plurality of such holes at equiangularly spaced positions about the central carburetor axis. These holes 51 play an important role in the proper functioning of my invention and will be discussed in greater detail at a later point in the description of the operation.

Figure 7:
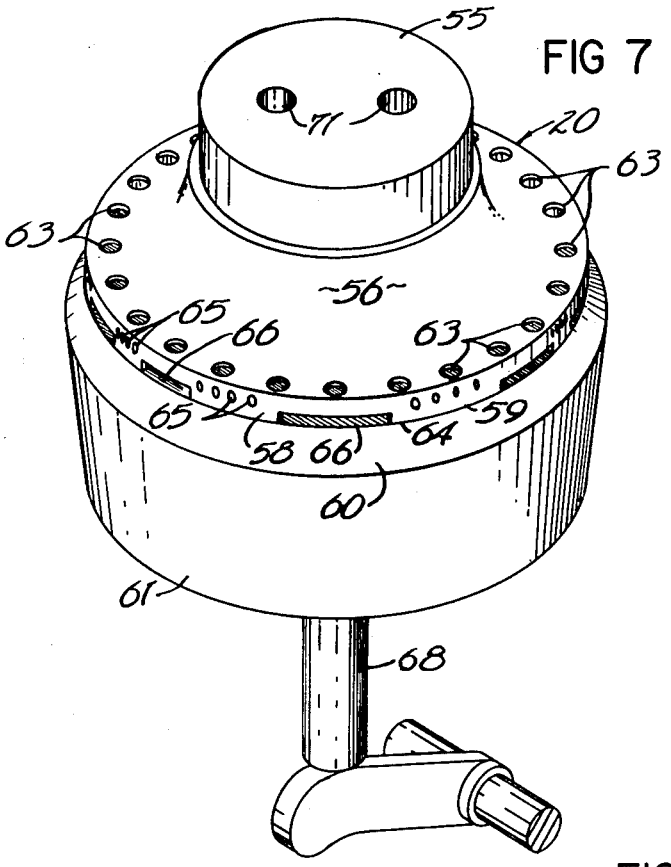
FIG. 7 is a pictorial view of the first venturi member and throttle mechanism.

Reference will not be made in particular detail to the first venturi member 20. This member is shown in detail by FIGS. 1, 7, and 8. Venturi member 20 is bell-shaped in configuration starting from a central upper reduced end 55. A convex portion 56 extends downward and radially outwardly from reduced end 55. Convex portion 56 ends in a downstream edge 57 from where an axial rim 58 extends. Axial rim 58 projects axially downward from edge 57 to a lower rim edge 59. As shown in FIG. 1, the structure including convex portion 56 and axial rim 58 may be provided independent of the remainder of venturi member 20. However, it is not critical that this be so and is entirely feasable that these portions be formed integrally along with the remaining portions of venturi member 20.

An outwardly beveled portion 60 extends down and outwardly from the lower rim edge 59 to a point of maximum diameter from the axis. From this point, an inwardly beveled portion 61 extends on downstream to terminate at a bottom venturi edge.

Another feature is the provision of a plurality of bleed holes 63 formed through convex portion 56. These holes openly communicate with an open chamber 64 within venturi member 20. Holes 63 are located radially inward of axial rim 58 to receive air from a point upstream of restricted air passage 22 and to direct it into the chamber 64. Included within axial rim 58 are a plurality of holes 65 and a number of slots 66 that communicate openly with chamber 64. It may be noted in FIGS. 2, 3, 7 and 8, that the holes 65 are located above slots 66.

Figure 6:
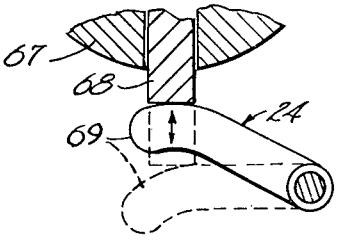
FIG. 6 is an operational detail of a throttle mechanism for the present invention.

First venturi member 20 is movably held along the central carburetor axis by throttle means 24. Included with the throttle means 24 is a central support body 67 that slidably receives a downwardly open cup shaped portion 67*a* of venturi member 20 that includes beveled portions 60 and 61. The hollow portion 67*a* is vented through upright holes 71 to relieve air pressure while venturi member 20 moves on body 67. A central upright shaft 68 extends downwardly from member 20 through an appropriate aperture formed through body 67. This shaft 68 slidably communicates with a cam 69 provided by throttle means 24. This cam is shown in detail by FIG. 6.

A linkage rod 70 is operatively connected to cam 69 and extends through the carburetor body 11 to communicate with a known form of throttle linkage ordinarily provided on internal combustion engines. The shaft 68 is rotatably journalled by the carburetor body to enable rotational movement of the cam 69 between positions shown by dashed and solid lines in FIG. 6. This movement of cam 69 results in corresponding up and downward movement of the first venturi member 20. Relative positions of venturi member 20 with respect to second venturi member 21 may be seen by comparing FIGS. 2, 3, and 8. FIG. 2 represents an idle position while FIG. 8 represents a full throttle setting.

As previously recited, the second venturi member 21 is formed integrally with the carburetor body 11. Venturi 21 is shown in substantial detail by FIGS. 1 and 8. A concave portion 72 of venturi 21 leads tangentially downwardly from an edge above the restricted air passage. This portion 72 leads into a convex portion 73 that connects tangentially thereto. Convex portion 73 leads on downward to the upper orifice edge 27.

Figure 3:
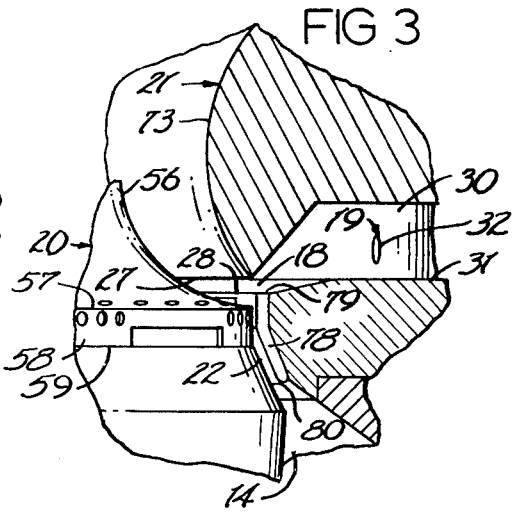
FIG. 3 is a view similar to FIG. 2 only showing a different operational condition.

Extending from the lower edge 28 then is a second axial rim 74. Rim 74 is complementary to and slightly larger in diameter than the corresponding rim 58 of first venturi member 20. Rim 74 leads downwardly to an outwardly beveled portion 75 that is complementary to the first beveled portion 60 of the first member 20. The beveled portions 60 and 75, along with rims 74 and 58 define the restricted air passage immediately adjacent to the orifice 18 during idle and high idle RPM as shown by FIGS. 2 and 3. A flared portion 76 extends out and downwardly from beveled portion 75 to tangentially join with the remaining portion of the carburetor interior.

FIGS. 5 and 8 show particular details of second venturi member 21 between lower orifice edge 28 and the lower edge of outwardly beveled portion 75. There is provided in this part of the second venturi member 21, a plurality of axial grooves 78 and slots 82. The axial grooves 78 are equiangularly spaced about the inside periphery of venturi member 21 and extend from top edges 79, openly communicating with orifice 18, to closed bottom edges 80. The edges 80 terminate at the juncture of beveled portion 75 and flared portion 76.

Also included with the present carburetor 10 is a water jacket 87. Jacket 87 extends about the periphery of the hollow carburetor interior adjacent fuel dispensing orifice 18. The jacket includes an infeed 88 and an outlet 89 adapted to receive a coolant from an engine's cooling system. Through this manner, the area in the vicinity of orifice 18 is heated by conduction. Water jacket 87 prevents icing within the carburetor at the points of highest air velocity adjacent orifice 18. It has been my experience that without provision of such a jacket 87, the extremely high velocity air will soon cause icing within the carburetor and result in poor operational efficiency.

OPERATION OF THE PRESENT INVENTION

Operation of the present invention may now be understood from the foregoing technical disclosure. First, prior to operation, the carburetor is installed on an existing engine with the lower end 13 bolted over the existing carburetor mounting surface of the intake manifold. A fuel line is then connected to float chamber and choke 17 and throttle means 24 are connected to the conventional throttle and choke linkage provided by the engine.

To start the engine, the throttle linkage is operated to move first venturi member 20 to a position adjacent the fuel dispensing orifice 18 as is shown in FIGS. 1 and 2. In this condition, the concave and convex portions of venturi members 20 and 21 funnel air from an upstream location downwardly toward and across the orifice 18. The engine then first pulls air and fuel through grooves 78 from the fuel supply means 19. This relatively rich mixture is ordinarily all that is required to start the engine running under its own power.

Once the engine is running, the vacuum within the manifold becomes so great that ordinary variable venturi carburetors would respond by delivering an excessively rich mixture of fuel and air to the engine. The present carburetor, however, avoids this problem by supplying air to the engine through several different routes.

In the low throttle condition, some idle air will enter the cavity 30 between the edges 27 and 28. This is accomplished as air is received through bleed holes 63 and directed radially outward through holes 65 that are presently aligned with the aperture 18. This provision serves to substantially reduce the vacuum within the cavity 30 and thereby controls the delivery of fuel from means 19.

In addition to the above feature, air is bled into orifices 18 through air bleed holes 51 provided within the second venturi member 21. The low pressure within cavity 30 is such that air is drawn downwardly through holes 51 and into orifice 18. The provision of adjusting means 52 facilitates adjustment of the idle air supply to cavity 30 and thereby will facilitate selective control of the air fuel mixture at the idle settings.

Features including the air bleed holes 51 and holes 63 and 65 will successfully meter the intake of fuel and air mixture while enabling fuel delivery through the single annular fuel dispensing orifice 18. Therefore, the fuel and air are brought together at a point where the air reaches its highest velocity. This serves to completely atomize and simultaneously mix the fuel and air together to develop a completely mixed charge for delivery to the engine cylinders.

In the idling position, fuel is drawn from orifice 18 through the upright axial grooves 78, partly through engine vacuum and partly by the tidal rush of air passing between surfaces 60 and 75.

To increase the speed of the engine from a slow idle to a fast idle, the throttle means is operated to slightly lower first venturi member 20 axially within mixing chamber 14. The downward force of air against first venturi member 20 facilitates its movement downward without the assistance of springs or any other attachment mechanism to the throttle linkage.

As venturi member 20 moves elevationally downward, the edge 57 of convex surface 56 moves downward toward alignment with the lower edge 28 of orifice 18. Excessive fuel is prevented from being pulled from the orifice 18 (as air passage 22 is enlarged) by the configuration of convex surface 56 and the axial alignment of orifice edge 27 and rim 58. In this condition, air is directed radially by convex surface 56 into the opening 18 to prevent the excessive withdrawal of fuel through supply means 19.

To increase the engine speed above a fast idle, first venturi 20 is again lowered so edge 57 is dropped below lower edge 28 of orifice 18. In this position, excessive fuel is again prevented from entering the main air stream as additional air is pulled directly into the top of slots 78.

An additional increase in engine's rate of speed brings the first venturi member 20 to the position shown by FIG. 3. In this position, the axial grooves 78 are not as effective because they are drawing considerably less air from orifice 18 and more air through slots 66 and holes 65. The fuel mixture is prevented from becoming too lean as the tidal rush of air passing orifice 18 creates a low pressure across the orifice opening. This low pressure serves to pull a mixture of fuel and air from supply means 19 into the air stream which now passes through grooves 78 as well as slots 82 in second venturi member 21 and holes 65, and the slots 66 provided in first venturi member 20.

As first venturi member 20 continues to move downwardly, air passage 22 is enlarged and air pressure is continually lowered at orifice 18 to pull additional fuel as air moves by at increasing velocity.

During high speed or full throttle operation, rim 58 is displaced vertically (axially) away from corresponding rim 74. In this condition, grooves 78 and slots 82 become ineffective for the purpose of metering fuel. A full throttle position of first and second venturi members 20, 21 is illustrated in FIG. 8. In this position, the convex curvature 56 directs air directly past orifice 18. In addition to the low pressure created at orifice 18, a suction force is produced as air passes at high velocity over bleed ducts 51 along concave portion 72 of second venturi member 21. High velocity air passing these orifices creates low pressure across their openings, which is transferred to cavity 30. This additional low pressure serves to draw more fuel through the supply means 19 in order to provide an appropriate rich mixture at the full throttle setting.

Low pressure within orifice 18 results in subsequent pressure drops within fuel well cavities 38. It is a function of holes 36 to respond to pressure differential within orifice 18 by drawing corresponding amounts of fuel and air from float chamber 44, from within fuel well bores 38.

Bores 38 serve as individual fuel wells for each tube 33. As air pressure in fuel well bores 38 drops, the fuel level will rise to successively cover more bleeder holes 36. This allows less air to be bled into the fuel passing through the tubes 33. They therefore deliver a richer fuel mixture to orifice 18.

The level to which the fuel will rise within bores 38 is determined by the remainder of uncovered holes 36 within tubes 33. The fuel will remain at any level as long as appropriate vacuum pressure is maintained. This is becuase the volume of air being bled into the remainder of holes 36 is replaced by air being drawn into bores 38 through holes 39.

The fuel level in each bore 38 will fluctuate as the pressure within orifice 18 fluctuates. In addition, the fuel level within the bores 38 will fluctuate as atmospheric pressure changes. This feature automatically meters the right amount of fuel to correspond with changes in altitude.

It is understood that various changes and modifications may be made in the above disclosure without departing from the intended scope of this invention. Therefore, only the following claims are to be taken as definitions or limitations upon the scope of the present invention.

What I claim is:

1. A variable venturi carburetor for an internal combustion engine, comprising:

a hollow carburetor body having an open air intake end and an open discharge end adapted to be mounted to an intake manifold of an internal combustion engine and a fuel-air mixing chamber having a vertical axis intermediate the ends for receiving and guiding air in a flow from the intake and through the open discharge end and into the manifold;

a first annular venturi surface in the mixing chamber, coaxial with the mixing chamber axis;

a second annular venturi surface in the mixing chamber coaxial with the mixing chamber axis in which the venturi surfaces form an annular restricted air passage therebetween within the mixing chamber;

throttle means operatively connected to at least one of the venturi surfaces for moving the surfaces relative to each other to automatically enlarge or reduce the restricted air passage in response to the movements of the throttle means to control the flow of air through the mixing chamber without a throttle valve;

an annular fuel dispensing orifice formed coaxially in one of the venturi surfaces and communicating with the restricted air passage;

a plurality of distinct fuel wells angularly spaced about the chamber axis;

a fuel supply means operatively connected to the plurality of fuel wells for supplying fuel to the fuel wells while maintaining a volume of air in the fuel wells above the fuel;

a plurality of fuel delivery tubes angularly spaced about the chamber axis and extending downward into respective fuel wells with lower ends of the tubes extending below the fuel level within the fuel wells and upper ends that extend above the fuel level;

wherein the fuel delivery tubes have premixing apertures formed therein communicating with the volume of air in the fuel wells above the fuel for enabling air to pass into the tubes to premix with the fuel; and an enlarged annular cavity formed in the body coaxial with the chamber axis and operatively intermediate the fuel delivery tubes and the annular fuel dispensing orifice for receiving air and fuel from the fuel delivery tubes to enable the air and fuel to thoroughly premix in the enlarged annular cavity prior to passing into the mixing chamber through the annular fuel dispensing orifice.

2. The variable venturi carburetor as defined in claim 1 further includes bleed means for bleeding atmospheric air into the enlarged annular cavity for regulating the vacuum pressure in the enlarged annular cavity.

3. The variable venturi carburetor as defined in claim 1 wherein each of the fuel delivery tubes has a series of vertically spaced premixing apertures formed therein to enable air to flow into the tubes as fuel is withdrawn from the fuel wells.

4. The variable venturi carburetor as defined in claim 3 wherein the tube apertures are formed in the tube along the tube length with some of the apertures located within the air space above the fuel and remainder located below the selected fuel level.

5. The variable venturi carburetor as defined in claim 4 wherein the carburetor includes means for varying the fuel level within the fuel wells with respect to the length of the tubes in relation to changes in atmospheric pressure.

6. the variable venturi carburetor as defined in claim 4 wherein the carburetor includes means for varying the fuel level within the fuel wells with respect to the length of the tubes in relation to changes in the vacuum pressure in the mixing chamber at the annular fuel orifice.

7. The variable venturi carburetor as defined in claim 6 further comprising a fuel reservoir in operative communication with the fuel wells and vent means for exposing the fuel reservoir to atmospheric pressure.

* * * * *